US010840074B2

(12) United States Patent
Cooks et al.

(10) Patent No.: US 10,840,074 B2
(45) **Date of Patent: *Nov. 17, 2020**

(54) SYSTEMS AND METHODS FOR CONDUCTING NEUTRAL LOSS SCANS IN A SINGLE ION TRAP

(71) Applicant: Purdue Research Foundation, West Lafayette, IN (US)

(72) Inventors: Robert Graham Cooks, West Lafayette, IN (US); Dalton Snyder, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/751,265

(22) Filed: Jan. 24, 2020

(65) Prior Publication Data

US 2020/0161111 A1 May 21, 2020

Related U.S. Application Data

(63) Continuation of application No. 15/985,188, filed on May 21, 2018, now Pat. No. 10,580,633.

(60) Provisional application No. 62/509,835, filed on May 23, 2017.

(51) Int. Cl.
*H01J 49/00* (2006.01)
*H01J 49/42* (2006.01)

(52) U.S. Cl.
CPC ..... *H01J 49/0036* (2013.01); *H01J 49/0081* (2013.01); *H01J 49/429* (2013.01); *H01J 49/422* (2013.01)

(58) Field of Classification Search
USPC ..... 250/282, 281
See application file for complete search history.

(56) References Cited

U.S. PATENT DOCUMENTS

2007/0084994 A1* 4/2007 Wang ..... H01J 49/428 250/282
2012/0032074 A1* 2/2012 Kenny ..... H01J 49/0031 250/283
2017/0221695 A1* 8/2017 Cooks ..... H01J 49/0013
2017/0345632 A1* 11/2017 McAlister ..... G01N 30/7233

* cited by examiner

*Primary Examiner* — Kiet T Nguyen
(74) *Attorney, Agent, or Firm* — Brown Rudnick LLP; Adam M. Schoen

(57) ABSTRACT

The invention generally relates to systems and methods for conducting neutral loss scans in a single ion trap. In certain aspects, the invention provides systems that include a mass spectrometer having a single ion trap, and a central processing unit (CPU), and storage coupled to the CPU for storing instructions that when executed by the CPU cause the system to apply a scan function that excites a precursor ion, rejects the precursor ion after its excitation, and ejects a product ion in the single ion trap.

20 Claims, 12 Drawing Sheets

SYSTEMS AND METHODS FOR CONDUCTING NEUTRAL LOSS SCANS IN A SINGLE ION TRAP

RELATED APPLICATION

The present application is a continuation of U.S. nonprovisional patent application Ser. No. 15/985,188, filed May 21, 2018, which claims the benefit of and priority to U.S. provisional application Ser. No. 62/509,835, filed May 23, 2017, the content of each of which is incorporated by reference herein in its entirety.

GOVERNMENT INTEREST

This invention was made with government support under NNX16AJ25G awarded by the National Aeronautics and Space Administration (NASA). The government has certain rights in the invention.

FIELD OF THE INVENTION

The invention generally relates to systems and methods for conducting neutral loss scans in a single ion trap.

BACKGROUND

The beginnings of tandem mass spectrometry (MS/MS or MS″) date back to the first mass-analyzed ion kinetic energy spectrometer (MIKES) developed at Purdue University. Tandem MS, the production and mass analysis of fragment ions from mass-selected precursor ions, is particularly useful for complex mixture analysis and has served as the backbone of fields as diverse as proteomics, forensics, environmental monitoring, and biomarker discovery.

Amongst the activation methods for MS/MS are collision-induced dissociation (CID), ultraviolet photo dissociation, infrared multiphoton dissociation, electron transfer dissociation, surface-induced dissociation, and others. Collision-induced dissociation has been especially notable in the development of the suite of MS/MS scan modes which includes three prominent members—product ion scans, precursor ion scans, and neutral loss scans—as well as other notable modes—doubly charged ion scans, reaction intermediate scans, multiple reaction monitoring, and functional relationship scans.

Although neutrals are not directly measurable by mass spectrometers, they are indirectly accessible by a variety of methods and they carry important analytical information. The two most prominent techniques for probing neutral species are neutralization-reionization mass spectrometry (NRMS) and the neutral loss scan in MS/MS. The NRMS experiment neutralizes a mass-selected ion, usually by charge exchange or CID, and the resulting neutral undergoes energetic collisions which produce neutral fragments that are re-ionized and mass analyzed. Hypervalent and other unusual species can be produced and characterized, a unique capability.

By contrast, in a neutral loss MS/MS experiment a precursor ion is mass-selected by a first mass analyzer and undergoes activation to produce a product ion and a neutral. The product ion is mass selected for detection by a second analyzer. For the neutral loss scan, the relationship between the precursor ion mass-to-charge ratio (m/z) and the product ion m/z is fixed—that is, the neutral mass is constant—and as such it describes a shared molecular functionality of a group of precursor ions. In comparison, the precursor ion scan selects a fixed product ion m/z which might also correspond to a common functionality in all precursor ions which yield this fragment.

Because mass selection of both precursor and product ion is necessitated in precursor ion and neutral loss scans, the prevailing wisdom in mass spectrometry has been that multiple mass analyzers are required.

SUMMARY

The invention provides systems and methods that demonstrate the corresponding neutral loss scan mode in a single linear ion trap using, in certain embodiments, orthogonal double resonance excitation.

In certain aspects, the invention provides systems including a mass spectrometer having a single ion trap, and a central processing unit (CPU), and storage coupled to the CPU for storing instructions that when executed by the CPU cause the system to apply a scan function that excites a precursor ion, rejects the precursor ion after its excitation, and ejects a product ion in the single ion trap.

It is envisioned that numerous types of scan functions can be used with systems and methods of the invention so long as the scan function is able to excite a precursor ion, reject the precursor ion after its excitation, and eject a product ion in the single ion trap. In certain embodiments, the scan function includes three swept-frequency scans that are preferably applied simultaneously to the single ion trap. In certain embodiments, each of the three swept-frequency scans is an inverse Mathieu q scan. In such embodiments, it is envisioned that a first frequency sweep excites the precursor ion, a second frequency sweep rejects the precursor ion after its excitation, and a third frequency sweep ejects a product ion in the single ion trap. Typically, the second frequency sweep is between the first frequency sweep and the third frequency sweep. In certain embodiments, a constant mass offset is maintained between the first frequency sweep and the third frequency sweep. In certain embodiments, the first frequency sweep includes a lower amplitude than either the second or third frequency sweeps.

Other aspects of the invention provide systems that include a mass spectrometer having a single ion trap, and a central processing unit (CPU), and storage coupled to the CPU for storing instructions that when executed by the CPU cause the system to conduct a neutral loss scan in the single ion trap through simultaneous application of three swept-frequency scans to the single ion trap. In certain embodiments, the first and second frequency sweeps are applied in a y dimension, and the third frequency sweep is applied in an x dimension and a detector of the mass spectrometer is also in the x dimension.

As discussed above and in certain embodiments, each of the three swept-frequency scans is an inverse Mathieu q scan. In such embodiments, it is envisioned that a first frequency sweep excites the precursor ion, a second frequency sweep rejects the precursor ion after its excitation, and a third frequency sweep ejects a product ion in the single ion trap. Typically, the second frequency sweep is between the first frequency sweep and the third frequency sweep. In certain embodiments, a constant mass offset is maintained between the first frequency sweep and the third frequency sweep. In certain embodiments, the first frequency sweep includes a lower amplitude than either the second or third frequency sweeps. In certain embodiments, the first and second frequency sweeps are applied in a y dimension, and the third frequency sweep is applied in an x dimension and a detector of the mass spectrometer is also in the x dimension.

The systems and of the invention allow for methods of recording mass/charge values of all precursor ions that fragment by loss of a neutral of constant mass to give product ions. With systems of the invention, a wide range of precursor/product pairs is interrogated and the neutral fragment mass can be selected arbitrarily. In certain embodiments, a scan is performed in a data independent fashion, optionally using a linear ion trap or a rectilinear ion trap.

In certain embodiments, the constant neutral loss scan is performed using an AC frequency scanning method at constant ion trapping conditions (constant RF amplitude and frequency). In a specific example, the AC frequency scan is performed using the inverse Mathieu q scan procedure. In such embodiments, it is possible for the AC frequency scans to be performed using AC frequencies corresponding to the precursor and product ions. These two AC signals may be applied to orthogonal sets of electrodes of an ion trap, such as a rectilinear or linear ion trap.

In certain embodiments, constant neutral loss is ensured by generating the AC signals from the same function generator and beginning their application to the electrodes at different times after initiation of a linear frequency ramp.

The implementation of neutral loss scans, as well as precursor ion scans, in a single mass analyzer is motivated by the constraints placed upon miniature and portable mass spectrometers, for which simple, power-efficient electronics, lenient vacuum conditions, and small footprints are important. These considerations eliminate multiple-analyzer mass spectrometers as candidate analyzers in a portable system. The constraints are further exacerbated in space science, where power consumption and instrument volume are of the utmost concern. It is envisioned that the invention herein will lead to the eventual implementation of both precursor ion and neutral loss scans on the next-generation linear ion traps developed at NASA Goddard Space Flight Center for detection of organic compounds on Mars.

BRIEF DESCRIPTION OF THE FIGURES

(FIG. 1A) As shown on the Mathieu stability diagram, three supplementary AC frequencies are scanned simultaneously at the same mass scan rate in order to excite precursor ions and simultaneously eject product ions of a constant mass offset from the precursors, while a third intermediate frequency is scanned (orthogonally) to reject artifactual unfragmented precursor ions. A scan table of the experiment is shown in (FIG. 1B), and (FIG. 1C) shows the directionality of the low voltage frequency sweeps (trapping RF not shown).

(FIG. 2A) Full AC scan using LTQ ESI of caffeine in Pierce calibration mixture, (FIG. 2B) neutral loss scan of 57 Th, and neutral loss scans with (FIG. 2C) artifact reject frequency off, (FIG. 2D) precursor ion excitation frequency off, (FIG. 2E) product ion ejection frequency off. Note the different intensity scales.

(FIG. 3A) full scan mass spectrum of amphetamine (amp), methamphetamine (map), 3,4-methylenedioxyamphetamine (mda), and 3,4-methylenedioxymethamphetamine (mdma), (FIG. 3B) neutral loss scan of 31 Da, and (FIG. 3C) neutral loss scan of 17 Da.

DETAILED DESCRIPTION

Figure 1A:
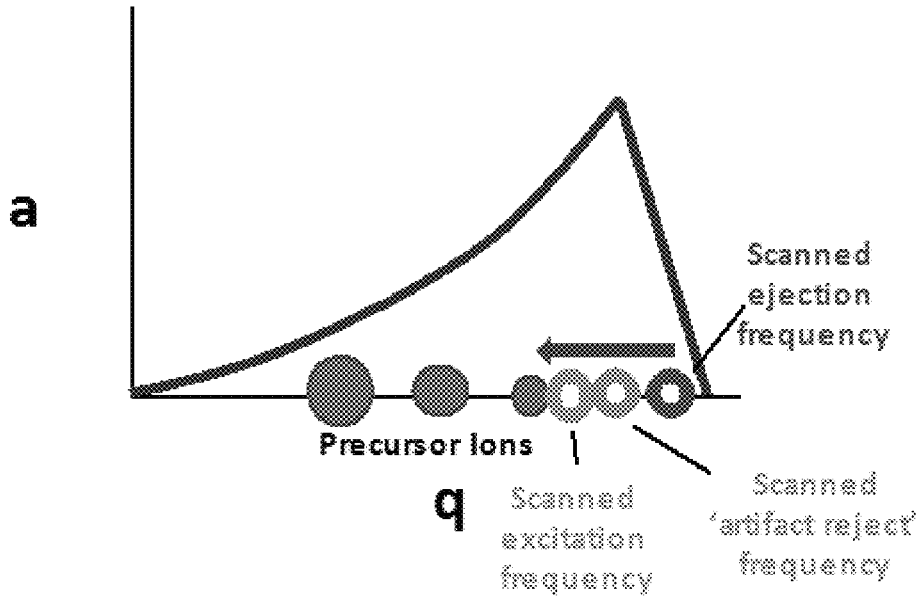
FIGS. 1A-C show methodology for single analyzer neutral loss scans in a linear quadrupole ion trap.

Since the initial development of linear quadrupole ion traps approximately a decade and a half ago, it has been the prevailing wisdom that single ion traps cannot perform data-independent precursor and neutral loss scans, two of the three main types of MS/MS experiments. As shown herein, quadrupole ion traps are extraordinarily versatile devices with access to all three major MS/MS scan types. Compared to previous variants of data-dependent neutral loss scanning, this double resonance neutral loss scan offers high efficiency in terms of time, RF power, and sample consumption. The demonstrated invention is completely data-independent and only requires a single mass scan segment and a single ion injection, making it particularly suitable for planetary exploration and other applications where significant constraints are imposed upon the instrument.

A Thermo Scientific LTQ linear ion trap mass spectrometer (San Jose, Calif., USA) was used for all experiments. The commercial RF coil was modified with an extra Thermo LTQ low pass filter board (part 97055-91120) and Thermo LTQ balun board (part 97055-91130) in order for low voltage AC signals to be applied to both x and y electrodes of the linear ion trap. As supplied commercially, the LTQ can only apply supplementary AC voltages to the x electrodes, the direction in which the detector lies, but as shown herein, orthogonality of excitation and ejection signals is important to obtaining unambiguous results.

The RF voltage for the invention herein was fixed by substituting the RF modulation signal between the main RF amplifier board and the RF detector board with a DC signal from an external function generator. The DC signal was directly proportional to the output voltage from the coil, as indicated by the calibrated lower-mass cutoff (LMCO) and mass scan rate values (Table 1).

TABLE 1

Experimental parameters for all neutral loss scans performed in this work.

| Figure | RF Modulation[1] ($mV_{pp}$) | LMCO (Th) | Scan Rate (Th/s) | Excitation Amplitude ($mV_{pp}$) | Artifact Reject Amplitude ($mV_{pp}$) | Eject Amplitude ($mV_{pp}$) | Excite Delay[2] (ms) | Artifact Reject Delay (ms) | Eject Delay (ms) | NL[3] (Da) |
|---|---|---|---|---|---|---|---|---|---|---|
| 2b | 210 | 100 | 1,740 | 400 | 2,700 | 1,200 | 75 | 91.35 | 112.6 | 57 |
| 3b | 150 | 70 | 1,140 | 150 | 440 | 400 | 75 | 85.35 | 99.6 | 31 |
| 3c | 150 | 70 | 1,140 | 140 | 190 | 400 | 75 | 80.35 | 94.5 | 19 |
| 4b | 210 | 100 | 1,740 | 600 | 3,400 | 1,200 | 75 | 91.35 | 107.6 | 59 |
| 5b | 300 | 200 | 2,900 | 400 | 2,000 | 1,600 | 75 | 79.35 | 87 | 44 |
| 6b | 200 | 110 | 1,580 | 500 | 700 | 700 | 135 | 140 | 147 | 18 |

[1]RF Modulation is the dc voltage substituted between the RF detector board and RF amplifier and is proportional to the RF amplitude (i.e. determines the LMCO).
[2]Delay time indicates trigger delay between the beginning of the ionization phase to the application of the waveform. The difference between the excite delay and eject delay is directly proportional to the neutral loss mass.
[3]NL = neutral loss For example, a modulation signal of 210 $mV_{pp}$ provided a LMCO of ~100 Th. Due to electronic constraints, the amplitude of the modulation signal did not vary through the scan period and was constant through the ionization, ion cooling, and mass scan time segments. The duty cycle of the modulation signal was ~90%, the remaining time being used in order to pulse the analyzer to zero voltage and thus clear the trap of ions after every scan.

Figure 1B:
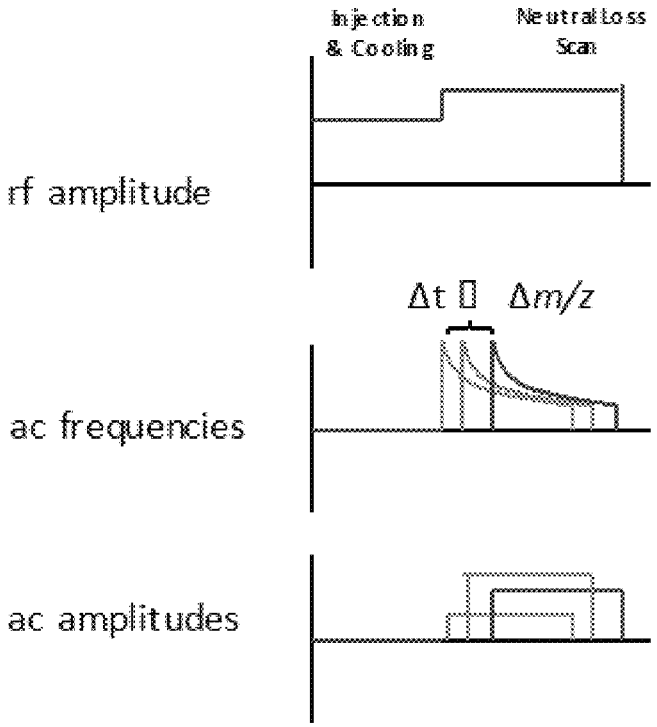

In certain embodiments, neutral loss scans were performed by simultaneously applying three swept-frequency sinusoidal inverse Mathieu q scans to the x and y electrodes of the linear ion trap, as shown in the Mathieu stability diagram in FIG. 1A and the scan table in FIG. 1B. In general, all of the inverse Mathieu q scans started at Mathieu q=0.908 and ended at q=0.15 approximately 300 ms later. These scans give an approximately linear relationship between excited/ejected ion m/z and time. A first frequency sweep was used for ion excitation, a second frequency sweep was used for precursor ion rejection after its excitation (artifact rejection), and a third frequency sweep was used for product ion ejection. The former two AC signals were summed and applied to the y electrodes and the third signal was applied to the x electrodes (FIG. 1C), viz. in the dimension in which ions are detected. The frequency sweeps were all calculated in Matlab and applied by two synced Keysight 33612A 2-channel waveform generators (Newark, S.C., USA). For application of two simultaneous frequency sweeps to the y electrodes, the two channels of one of the generators were summed into a single channel, a built-in feature of these Keysight units. The second Keysight generator supplied the product ion ejection frequency sweep and the dc signal for RF modulation.

In order to maintain a constant mass offset between the excitation frequency sweep and the ejection frequency sweep—an element for a neutral loss scan—the delay time between application of the excitation sweep and ejection sweep had to be varied. Because $t \propto m/z$, to a close approximation, for the inverse Mathieu q scan, a time offset between two identical frequency sweeps corresponds to a constant mass offset throughout the mass scan. The time offset could be approximated from the calibrated mass scan rate. Once the time offset was selected and verified experimentally, the time offset between the excitation frequency sweep and the artifact reject sweep was made approximately half the offset between the excitation and ejection sweeps. The artifact rejection sweep ejects into the y electrodes precursor ions that survive the excitation sweep.

The function generators were triggered just before the ionization period using the triggers built into the LTQ 'Diagnostics' menu, and the trigger delay was then adjusted so that the neutral loss scan started at the beginning of the LTQ's data acquisition period (i.e. mass scan). For a built-in scan function, the commercial 'Ultrazoom' scan was chosen. However, the 'Ultrazoom' selection as used here did not control the scan rate or RF amplitude; it only controlled the length of data acquisition and digitization rate of the detection electronics.

In certain embodiments, in order to mass-selectively fragment precursor ions as a function of time, a first swept-frequency sinusoidal AC signal is applied to the y electrodes. To eject a particular product ion, a second AC signal with fixed frequency corresponding to that of the product ion is applied simultaneously to the x electrodes (direction in which ions are detected). The orthogonality of the excitation and ejection AC signals is important to preventing artifacts from being observed in the mass spectrum because precursor ions can be unintentionally ejected during the excitation frequency sweep. Thus, a signal is observed at the detector only when a precursor ion fragments to the product ion whose secular frequency is selected for ejection. Mass information is preserved in the ejection time of the product ion, which correlates to the fragmentation time of the precursor ion.

Neutral loss scans in a single linear ion trap have similarities to precursor ion scans but are significantly more complex. The difficulty stems from the following differences: 1) the ejection frequency is scanned and hence it will eject both undesired precursor ions that survive fragmentation as well as the desired product ions formed during fragmentation, and 2) the excitation and ejection frequency sweeps have a constant mass offset through the entire mass scan (a difficult task due to the complex relationship between secular frequency and ion m/z).

The first problem can be mitigated by scanning a third frequency for 'artifact rejection' (FIGS. 1A-B). The artifact rejection frequency is desirably placed between the excitation and ejection frequencies. Hence, during the simultaneous sweep of all three frequencies, precursor ions will first fragment because of the y-dimension excitation, neutral loss products will simultaneously be ejected into the detector by the dipolar x-direction ejection sweep, and leftover precursor ions will be ejected into the y electrodes by the artifact rejection sweep.

The second problem is maintenance of a constant mass offset between the excitation and ejection frequencies. The fact that the relationship between ion secular frequency and m/z cannot be described analytically but instead requires a numerical or analytical (i.e. a finite equation) approximation makes calculation of the frequency sweeps difficult unless the relationship between m/z and time is linear, as is the case for the inverse Mathieu q scan. By using this nonlinear frequency sweep for excitation, ejection, and artifact rejection, a simple experimental parameter, the delay time between the frequency sweeps, then determines the mass of the neutral loss (FIG. 1B). This fortunate relationship is best applicable to the inverse Mathieu q scan because $t \propto m/z$ and therefore $\Delta t \propto \Delta m/z$.

The amplitude of each of the three frequency sweeps should be adjusted according to the intended function. The excitation sweep should have the lowest amplitude so that it activates, not ejects, precursor ions. The artifact rejection and product ion ejection sweeps should both have higher amplitudes in order to eject precursor and product ions, respectively. The former should be adjusted to 1) prevent premature ejection of precursors but also 2) to efficiently eject precursors after activation. Importantly, the smaller the neutral loss mass, the closer each frequency sweep will be and hence the lower the amplitude that will be used for artifact rejection. The product ion ejection amplitude should be adjusted for sensitivity and resolution. In this work, the excitation signal was a few hundred millivolts, whereas the rejection and ejection sweeps were generally 3-6 times higher in amplitude. See Table 1 for all experimental parameters.

Figure 1C:
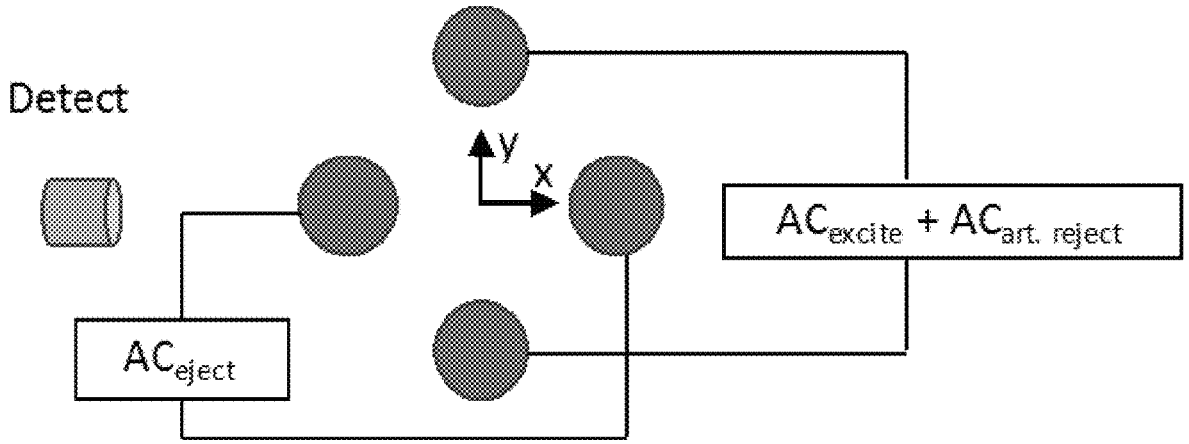

In one embodiment of neutral loss scan in a single ion trap, a first inverse Mathieu q scan activates precursor ions, and simultaneous sweeps of two additional inverse Mathieu q scans with appropriate time delays, reject leftover precursor ions and eject product ions. The three AC waveforms are identical inverse Mathieu q scans which allows one to easily maintain a constant mass offset. The excitation and artifact reject sweeps are applied in the y dimension to reduce artifacts from ejection of precursor ions, and the ejection sweep is applied in the x direction, where the detector is placed (FIG. 1C). The amplitude of each signal is adjusted for its intended function.

While not limiting, it is believed that methodologically, there are at three differences between single analyzer precursor ion scans and neutral loss scans under constant radiofrequency (RF) conditions: 1) in the latter experiment both excitation and ejection frequencies are scanned, whereas in the former the ejection frequency is fixed, 2) the need to maintain a constant neutral loss while incrementing both precursor and product ion masses—complicated by the complex relationship between secular frequency and mass—involves use of two simultaneous frequency scans, both linear in mass, and 3) because the ejection frequency is scanned, a third AC signal placed between the AC excitation and AC ejection frequency scans is also applied and scanned in order to reject artifact peaks caused by ejection of unfragmented precursor ions.

Inverse Mathieu q Scan

An inverse Mathieu q scan is described in U.S. application Ser. No. 15/789,688, the content of which is incorporated by reference herein in its entirety. An inverse Mathieu q scan operates using a method of secular frequency scanning in which mass-to-charge is linear with time. This approach contrasts with linear frequency sweeping that requires a complex nonlinear mass calibration procedure. In the current approach, mass scans are forced to be linear with time by scanning the frequency of a supplementary alternating current (supplementary AC) so that there is an inverse relationship between an ejected ion's Mathieu q parameter and time. Excellent mass spectral linearity is observed using the inverse Mathieu q scan. The rf amplitude is shown to control both the scan range and the scan rate, whereas the AC amplitude and scan rate influence the mass resolution. The scan rate depends linearly on the rf amplitude, a unique feature of this scan. Although changes in either rf or AC amplitude affect the positions of peaks in time, they do not change the mass calibration procedure since this only requires a simple linear fit of m/z vs time. The inverse Mathieu q scan offers a significant increase in mass range and power savings while maintaining access to linearity, paving the way for a mass spectrometer based completely on AC waveforms for ion isolation, ion activation, and ion ejection.

Methods of scanning ions out of quadrupole ion traps for external detection are generally derived from the Mathieu parameters $a_u$ and $q_u$, which describe the stability of ions in quadrupolar fields with dimensions u. For the linear ion trap with quadrupole potentials in x and y, $$q_x=-q_y=8zeV_{0\text{-}p}/\Omega^2(x_0^2+y_0^2)m \quad (1)$$

$$a_x=-a_y=16zeU/\Omega^2(x_0^2+y_0^2)m \quad (2)$$

where z is the integer charge of the ion, e is the elementary charge, U is the DC potential between the rods, $V_{0\text{-}p}$, is the zero-to-peak amplitude of the quadrupolar radiofrequency (rf) trapping potential, Ω is the angular rf frequency, $x_0$ and $y_0$ are the half distances between the rods in those respective dimensions, and m is the mass of the ion. When the dimensions in x and y are identical ($x_0=y_0$), $2r_0^2$ can be substituted for $(x_0^2+y_0^2)$. Solving for m/z, the following is obtained:

$$m/z=4V_{0\text{-}p}/q_x\Omega^2r_0^2 \quad (3)$$

$$m/z=8U/a_x\Omega^2r_0^2 \quad (4)$$

Ion traps are generally operated without DC potentials ($a_u$=U=0) so that all ions occupy the q axis of the Mathieu stability diagram. In the boundary ejection method, first demonstrated in the 3D trap and in the linear ion trap, the rf amplitude is increased so that ions are ejected when their trajectories become unstable at q=0.908, giving a mass spectrum, i.e. a plot of intensity vs m/z since m/z and rf amplitude (i.e. time) are linearly related.

The basis for an inverse Mathieu q scan is derived from the nature of the Mathieu parameter $q_u$ (eq. 3). In order to scan linearly with m/z at constant rf frequency and amplitude, the $q_u$ value of the m/z value being excited should be scanned inversely with time t so that $$q_u=k/(t-j) \quad (5)$$

where k and j are constants determined from the scan parameters. In the mode of operation demonstrated here, the maximum and minimum $q_u$ values ($q_{max}$ and $q_{min}$), which determine the m/z range in the scan, are specified by the user. Because the inverse function does not intersect the q axis (e.g. $q_u=1/t$), the parameter j is used for translation so that the first q value is $q_{max}$. This assumes a scan from high q to low q, which will tend to give better resolution and sensitivity due to the ion frequency shifts mentioned above.

The parameters j and k are calculated from the scan parameters, $$j=q_{min}\Delta t/(q_{min}-q_{max}) \quad (6)$$

$$k=-q_{max}j \quad (7)$$

where Δt is the scan time. Operation in Mathieu q space gives advantages: 1) the waveform frequencies depend only on the rf frequency, not on the rf amplitude or the size or geometry of the device, which implies that the waveform only has to be recalculated if the rf frequency changes (alternatively, the rf amplitude can compensate for any drift in rf frequency), and 2) the mass range and scan rate are controlled by the rf amplitude, mitigating the need for recalculating the waveform in order to change either parameter. It is important to note that we purposely begin with an array of $q_u$ values instead of m/z values for these very reasons.

Once an array of Mathieu $q_u$ values is chosen, they are converted to secular frequencies, which proceeds first through the calculation of the Mathieu $\beta_u$ parameter, $$\beta_u^2 = a_u + \cfrac{q_u^2}{(\beta_u+2)^2 - a_u - \cfrac{q_u^2}{(\beta_u+4)^2 - a_u - \cfrac{q_u^2}{(\beta_u+6)^2 - a_u - \ldots}}} + \cfrac{q_u^2}{(\beta_u-2)^2 - a_u - \cfrac{q_u^2}{(\beta_u-4)^2 - a_u - \cfrac{q_u^2}{(\beta_u-6)^2 - a_u - \ldots}}} \tag{8}$$

a conversion that can be done by using the algorithm described in Snyder et al. (Rapid Commun. Mass Spectrom. 2016, 30, 1190), the content of which is incorporated by reference herein in its entirety. The final step is to convert Mathieu $\beta_u$ values to secular frequencies (eqns. 9, 10) to give applied AC frequency vs time. Each ion has a set of secular frequencies, $$\omega_{u,n}=|2n+\beta_u|\Omega/2 \quad -\infty<n<\infty \tag{9}$$

where n is an integer, amongst which is the primary resonance frequency, the fundamental secular frequency, $$\omega_{u,0}=\beta_u\Omega/2 \tag{10}$$

This conversion gives an array of frequencies for implementation into a custom waveform calculated in a mathematics suite (e.g. Matlab).

Prior work used a logarithmic sweep of the AC frequency for secular frequency scanning, but, as described here, the relationship between secular frequency and m/z is not logarithmic, resulting in very high mass errors during mass calibration.

In theory, once the Mathieu $q_u$ parameters are converted to secular frequencies, a waveform is obtained. However, this waveform should not be used for secular frequency scanning due to the jagged edges observed throughout the waveform (i.e. phase discontinuities). In the mass spectra, this is observed as periodic spikes in the baseline intensities. Instead, in order to perform a smooth frequency scan, a new parameter $\Phi$ is introduced. This corresponds to the phase of the sinusoid at every time step (e.g. the $i^{th}$ phase in the waveform array, where i is an integer from 0 to $v*\Delta t-1$). Instead of scanning the frequency of the waveform, the phase of the sinusoid is instead scanned in order to maintain a continuous phase relationship. The relationship between ordinary (i.e. not angular) frequency f and phase $\Phi$ is:

$$f(t)=(1/2\pi)(d\Phi/dt)(t) \tag{11}$$

so that $$\Phi(t)=\Phi(0)+2\pi\int_0 f(\tau)d\tau \tag{12}$$

where variable $\tau$ has been substituted for time t in order to prevent confusion between the integration limit t and the time variable in the integrand. Thus, the phase of the sine wave at a given time t can be obtained by integrating the function that describes the frequency of the waveform as a function of time, which was previously calculated.

We begin with the phase of the waveform set equal to zero:

$$\Phi(0)=0(t=0) \tag{13}$$

The phase is then incremented according to eqns. 14 and 15, which accumulates (integrates) the frequency of the sinusoid, so that $$\Delta=\omega_{u,0}/v \tag{14}$$

$$\Phi(i+1)=\Phi(i)+\Delta \tag{15}$$

where v is the sampling rate of the waveform generator. Note that $\omega_{u,0}$ is the angular secular frequency ($2*\pi*f_{u,0}$, where $f_{u,0}$ is the ordinary secular frequency in Hz) in units of radians/sec. Thus, sweeping through phase $\Phi$ (FIG. 1D) instead of frequency gives a smooth frequency sweep.

Because the relationship between secular frequency and time is approximately an inverse function, the phase will be swept according to the integral of an inverse function, which is a logarithmic function. However, because the relationship between secular frequency and m/z is only approximately an inverse relationship, the phase $\Phi$ will deviate from the log function and thus cannot be described analytically (due to eq. 8).

Ion Traps and Mass Spectrometers

Any ion trap known in the art can be used in systems of the invention. Exemplary ion traps include a hyperbolic ion trap (e.g., U.S. Pat. No. 5,644,131, the content of which is incorporated by reference herein in its entirety), a cylindrical ion trap (e.g., Bonner et al., International Journal of Mass Spectrometry and Ion Physics, 24(3):255-269, 1977, the content of which is incorporated by reference herein in its entirety), a linear ion trap (Hagar, Rapid Communications in Mass Spectrometry, 16(6):512-526, 2002, the content of which is incorporated by reference herein in its entirety), and a rectilinear ion trap (U.S. Pat. No. 6,838,666, the content of which is incorporated by reference herein in its entirety).

Any mass spectrometer (e.g., bench-top mass spectrometer of miniature mass spectrometer) may be used in systems of the invention and in certain embodiments the mass spectrometer is a miniature mass spectrometer. An exemplary miniature mass spectrometer is described, for example in Gao et al. (Anal. Chem. 2008, 80, 7198-7205), the content of which is incorporated by reference herein in its entirety. In comparison with the pumping system used for lab-scale instruments with thousands of watts of power, miniature mass spectrometers generally have smaller pumping systems, such as a 18 W pumping system with only a 5 L/min (0.3 $m^3$/hr) diaphragm pump and a 11 L/s turbo pump for the system described in Gao et al. Other exemplary miniature mass spectrometers are described for example in Gao et al. (Anal. Chem., 2008, 80, 7198-7205), Hou et al. (Anal. Chem., 2011, 83, 1857-1861), and Sokol et al. (Int. J. Mass Spectrom., 2011, 306, 187-195), the content of each of which is incorporated herein by reference in its entirety.

Figure 7:
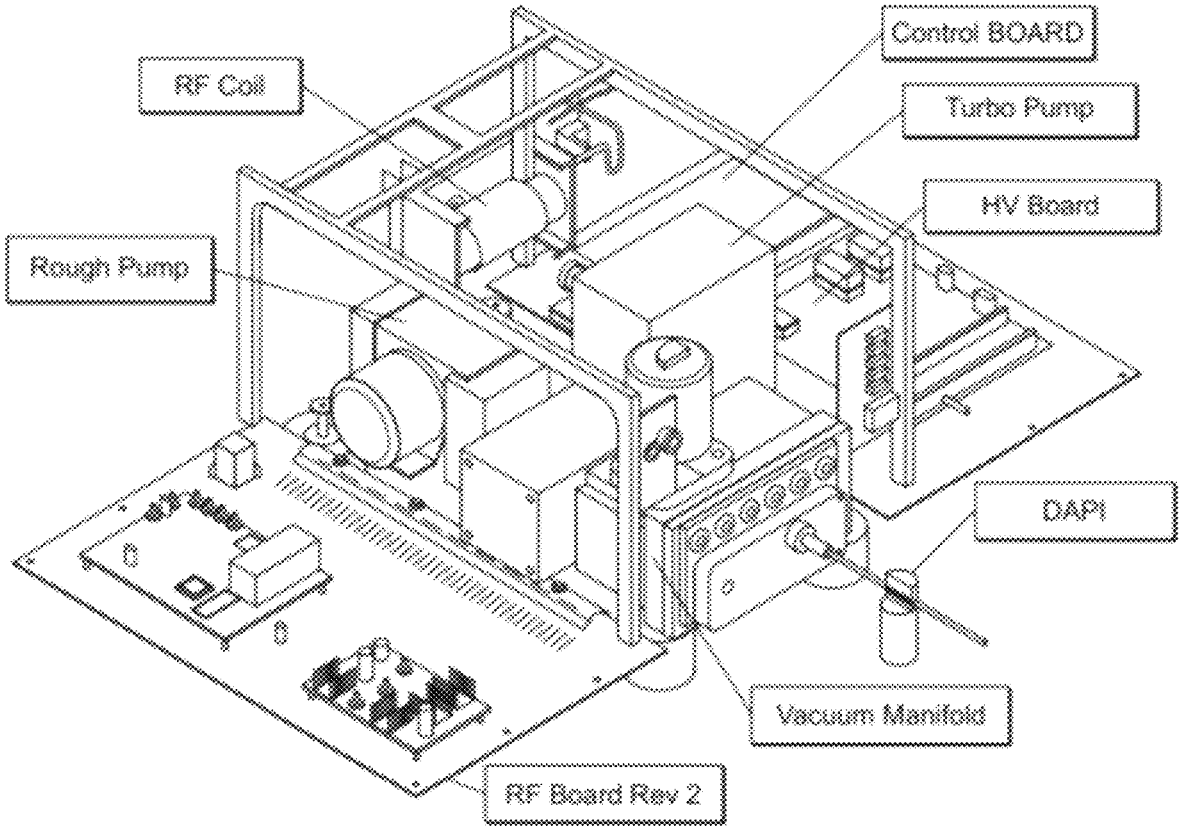
FIG. 7 is a picture illustrating various components and their arrangement in a miniature mass spectrometer.

FIG. 7 is a picture illustrating various components and their arrangement in a miniature mass spectrometer. The control system of the Mini 12 (Linfan Li, Tsung-Chi Chen, Yue Ren, Paul I. Hendricks, R. Graham Cooks and Zheng Ouyang "Miniature Ambient Mass Analysis System" Anal. Chem. 2014, 86 2909-2916, DOI: 10.1021/ac403766c; and 860. Paul I. Hendricks, Jon K. Dalgleish, Jacob T. Shelley, Matthew A. Kirleis, Matthew T. McNicholas, Linfan Li, Tsung-Chi Chen, Chien-Hsun Chen, Jason S. Duncan, Frank Boudreau, Robert J. Noll, John P. Denton, Timothy A.

Roach, Zheng Ouyang, and R. Graham Cooks "Autonomous in-situ analysis and real-time chemical detection using a backpack miniature mass spectrometer: concept, instrumentation development, and performance" Anal. Chem., 2014, 86 2900-2908 DOI: 10.1021/ac403765x, the content of each of which is incorporated by reference herein in its entirety), and the vacuum system of the Mini 10 (Liang Gao, Qingyu Song, Garth E. Patterson, R. Graham Cooks and Zheng Ouyang, "Handheld Rectilinear Ion Trap Mass Spectrometer", Anal. Chem., 78 (2006) 5994-6002 DOI: 10.1021/ac061144k, the content of which is incorporated by reference herein in its entirety) may be combined to produce the miniature mass spectrometer shown in FIG. 7. It may have a size similar to that of a shoebox (H20×W25 cm×D35 cm). In certain embodiments, the miniature mass spectrometer uses a dual LIT configuration, which is described for example in Owen et al. (U.S. patent application Ser. No. 14/345,672), and Ouyang et al. (U.S. patent application Ser. No. 61/865,377), the content of each of which is incorporated by reference herein in its entirety.

Ionization Sources

In certain embodiments, the systems of the invention include an ionizing source, which can be any type of ionizing source known in the art. Exemplary mass spectrometry techniques that utilize ionization sources at atmospheric pressure for mass spectrometry include paper spray ionization (ionization using wetted porous material, Ouyang et al., U.S. patent application publication number 2012/0119079), electrospray ionization (ESI; Fenn et al., Science, 1989, 246, 64-71; and Yamashita et al., J. Phys. Chem., 1984, 88, 4451-4459); atmospheric pressure ionization (APCI; Carroll et al., Anal. Chem. 1975, 47, 2369-2373); and atmospheric pressure matrix assisted laser desorption ionization (AP-MALDI; Laiko et al. Anal. Chem., 2000, 72, 652-657; and Tanaka et al. Rapid Commun. Mass Spectrom., 1988, 2, 151-153). The content of each of these references is incorporated by reference herein in its entirety.

Exemplary mass spectrometry techniques that utilize direct ambient ionization/sampling methods include desorption electrospray ionization (DESI; Takats et al., Science, 2004, 306, 471-473, and U.S. Pat. No. 7,335,897); direct analysis in real time (DART; Cody et al., Anal. Chem., 2005, 77, 2297-2302); atmospheric pressure dielectric barrier discharge Ionization (DBDI; Kogelschatz, Plasma Chemistry and Plasma Processing, 2003, 23, 1-46, and PCT international publication number WO 2009/102766), and electrospray-assisted laser desorption/ionization (ELDI; Shiea et al., J. Rapid Communications in Mass Spectrometry, 2005, 19, 3701-3704). The content of each of these references in incorporated by reference herein its entirety.

System Architecture

Figure 8:
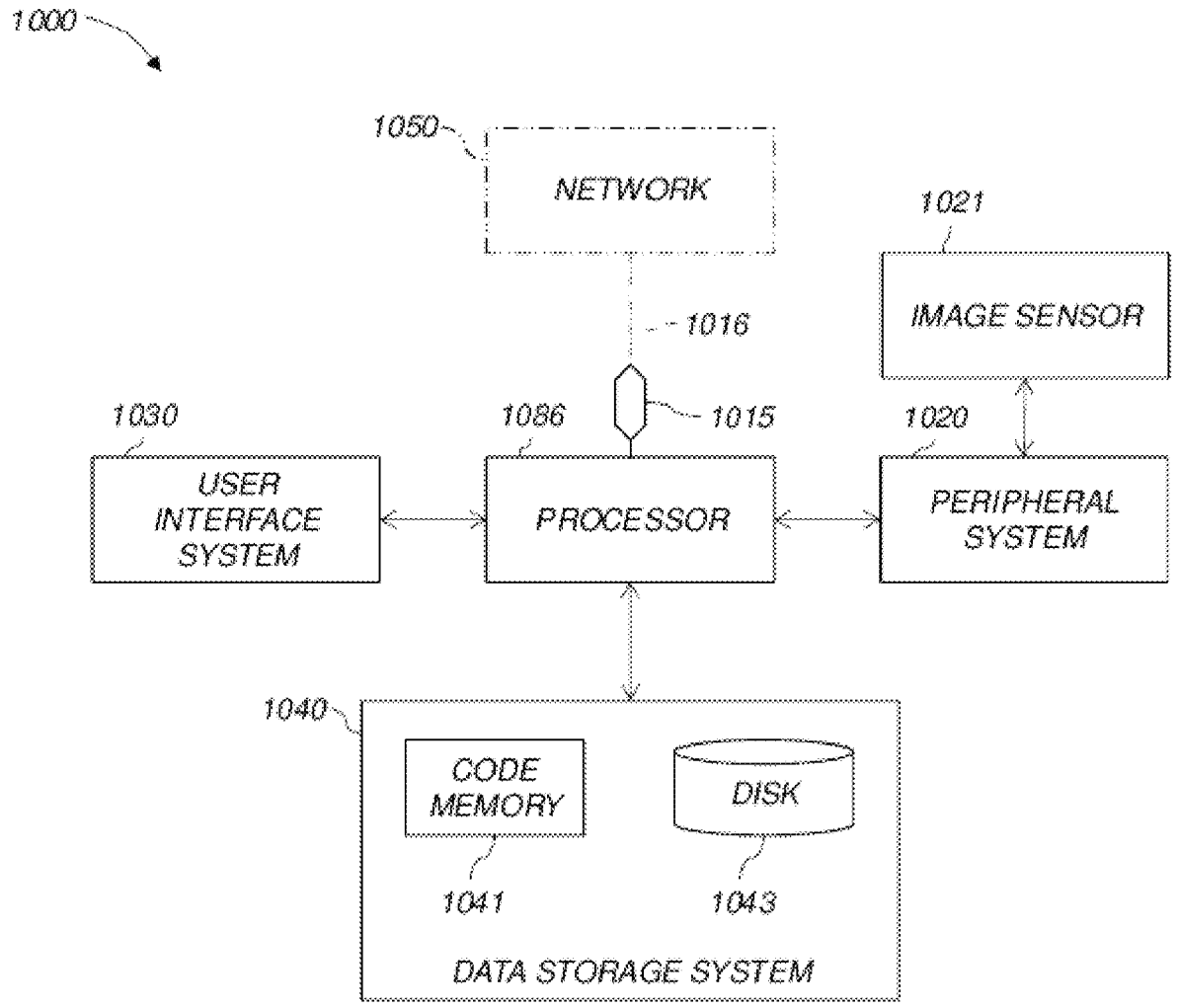
FIG. 8 shows a high-level diagram of the components of an exemplary data-processing system for analyzing data and performing other analyses described herein, and related components.

FIG. 8 is a high-level diagram showing the components of an exemplary data-processing system 1000 for analyzing data and performing other analyses described herein, and related components. The system includes a processor 1086, a peripheral system 1020, a user interface system 1030, and a data storage system 1040. The peripheral system 1020, the user interface system 1030 and the data storage system 1040 are communicatively connected to the processor 1086. Processor 1086 can be communicatively connected to network 1050 (shown in phantom), e.g., the Internet or a leased line, as discussed below. The data described above may be obtained using detector 1021 and/or displayed using display units (included in user interface system 1030) which can each include one or more of systems 1086, 1020, 1030, 1040, and can each connect to one or more network(s) 1050. Processor 1086, and other processing devices described herein, can each include one or more microprocessors, microcontrollers, field-programmable gate arrays (FPGAs), application-specific integrated circuits (ASICs), programmable logic devices (PLDs), programmable logic arrays (PLAs), programmable array logic devices (PALs), or digital signal processors (DSPs).

Processor 1086 which in one embodiment may be capable of real-time calculations (and in an alternative embodiment configured to perform calculations on a non-real-time basis and store the results of calculations for use later) can implement processes of various aspects described herein. Processor 1086 can be or include one or more device(s) for automatically operating on data, e.g., a central processing unit (CPU), microcontroller (MCU), desktop computer, laptop computer, mainframe computer, personal digital assistant, digital camera, cellular phone, smartphone, or any other device for processing data, managing data, or handling data, whether implemented with electrical, magnetic, optical, biological components, or otherwise. The phrase "communicatively connected" includes any type of connection, wired or wireless, for communicating data between devices or processors. These devices or processors can be located in physical proximity or not. For example, subsystems such as peripheral system 1020, user interface system 1030, and data storage system 1040 are shown separately from the data processing system 1086 but can be stored completely or partially within the data processing system 1086.

The peripheral system 1020 can include one or more devices configured to provide digital content records to the processor 1086. For example, the peripheral system 1020 can include digital still cameras, digital video cameras, cellular phones, or other data processors. The processor 1086, upon receipt of digital content records from a device in the peripheral system 1020, can store such digital content records in the data storage system 1040.

The user interface system 1030 can include a mouse, a keyboard, another computer (e.g., a tablet) connected, e.g., via a network or a null-modem cable, or any device or combination of devices from which data is input to the processor 1086. The user interface system 1030 also can include a display device, a processor-accessible memory, or any device or combination of devices to which data is output by the processor 1086. The user interface system 1030 and the data storage system 1040 can share a processor-accessible memory.

In various aspects, processor 1086 includes or is connected to communication interface 1015 that is coupled via network link 1016 (shown in phantom) to network 1050. For example, communication interface 1015 can include an integrated services digital network (ISDN) terminal adapter or a modem to communicate data via a telephone line; a network interface to communicate data via a local-area network (LAN), e.g., an Ethernet LAN, or wide-area network (WAN); or a radio to communicate data via a wireless link, e.g., WiFi or GSM. Communication interface 1015 sends and receives electrical, electromagnetic or optical signals that carry digital or analog data streams representing various types of information across network link 1016 to network 1050. Network link 1016 can be connected to network 1050 via a switch, gateway, hub, router, or other networking device.

Processor 1086 can send messages and receive data, including program code, through network 1050, network link 1016 and communication interface 1015. For example, a server can store requested code for an application program (e.g., a JAVA applet) on a tangible non-volatile computer-readable storage medium to which it is connected. The server can retrieve the code from the medium and transmit it through network 1050 to communication interface 1015. The received code can be executed by processor 1086 as it is received, or stored in data storage system 1040 for later execution.

Data storage system 1040 can include or be communicatively connected with one or more processor-accessible memories configured to store information. The memories can be, e.g., within a chassis or as parts of a distributed system. The phrase "processor-accessible memory" is intended to include any data storage device to or from which processor 1086 can transfer data (using appropriate components of peripheral system 1020), whether volatile or non-volatile; removable or fixed; electronic, magnetic, optical, chemical, mechanical, or otherwise. Exemplary processor-accessible memories include but are not limited to: registers, floppy disks, hard disks, tapes, bar codes, Compact Discs, DVDs, read-only memories (ROM), Universal Serial Bus (USB) interface memory device, erasable programmable read-only memories (EPROM, EEPROM, or Flash), remotely accessible hard drives, and random-access memories (RAMs). One of the processor-accessible memories in the data storage system 1040 can be a tangible non-transitory computer-readable storage medium, i.e., a non-transitory device or article of manufacture that participates in storing instructions that can be provided to processor 1086 for execution.

In an example, data storage system 1040 includes code memory 1041, e.g., a RAM, and disk 1043, e.g., a tangible computer-readable rotational storage device such as a hard drive. Computer program instructions are read into code memory 1041 from disk 1043. Processor 1086 then executes one or more sequences of the computer program instructions loaded into code memory 1041, as a result performing process steps described herein. In this way, processor 1086 carries out a computer implemented process. For example, steps of methods described herein, blocks of the flowchart illustrations or block diagrams herein, and combinations of those, can be implemented by computer program instructions. Code memory 1041 can also store data, or can store only code.

Various aspects described herein may be embodied as systems or methods. Accordingly, various aspects herein may take the form of an entirely hardware aspect, an entirely software aspect (including firmware, resident software, micro-code, etc.), or an aspect combining software and hardware aspects. These aspects can all generally be referred to herein as a "service," "circuit," "circuitry," "module," or "system."

Furthermore, various aspects herein may be embodied as computer program products including computer readable program code stored on a tangible non-transitory computer readable medium. Such a medium can be manufactured as is conventional for such articles, e.g., by pressing a CD-ROM. The program code includes computer program instructions that can be loaded into processor 1086 (and possibly also other processors) to cause functions, acts, or operational steps of various aspects herein to be performed by the processor 1086 (or other processor). Computer program code for carrying out operations for various aspects described herein may be written in any combination of one or more programming language(s), and can be loaded from disk 1043 into code memory 1041 for execution. The program code may execute, e.g., entirely on processor 1086, partly on processor 1086 and partly on a remote computer connected to network 1050, or entirely on the remote computer.

Discontinuous Atmospheric Pressure Interface (DAPI)

In certain embodiments, the systems of the invention can be operated with a Discontinuous Atmospheric Pressure Interface (DAPI). A DAPI is particularly useful when coupled to a miniature mass spectrometer, but can also be used with a standard bench-top mass spectrometer. Discontinuous atmospheric interfaces are described in Ouyang et al. (U.S. Pat. No. 8,304,718 and PCT application number PCT/US2008/065245), the content of each of which is incorporated by reference herein in its entirety.

Samples

A wide range of heterogeneous samples can be analyzed, such as biological samples, environmental samples (including, e.g., industrial samples and agricultural samples), and food/beverage product samples, etc.

Exemplary environmental samples include, but are not limited to, groundwater, surface water, saturated soil water, unsaturated soil water; industrialized processes such as waste water, cooling water; chemicals used in a process, chemical reactions in an industrial processes, and other systems that would involve leachate from waste sites; waste and water injection processes; liquids in or leak detection around storage tanks; discharge water from industrial facilities, water treatment plants or facilities; drainage and leachates from agricultural lands, drainage from urban land uses such as surface, subsurface, and sewer systems; waters from waste treatment technologies; and drainage from mineral extraction or other processes that extract natural resources such as oil production and in situ energy production.

Additionally exemplary environmental samples include, but certainly are not limited to, agricultural samples such as crop samples, such as grain and forage products, such as soybeans, wheat, and corn. Often, data on the constituents of the products, such as moisture, protein, oil, starch, amino acids, extractable starch, density, test weight, digestibility, cell wall content, and any other constituents or properties that are of commercial value is desired.

Exemplary biological samples include a human tissue or bodily fluid and may be collected in any clinically acceptable manner. A tissue is a mass of connected cells and/or extracellular matrix material, e.g. skin tissue, hair, nails, nasal passage tissue, CNS tissue, neural tissue, eye tissue, liver tissue, kidney tissue, placental tissue, mammary gland tissue, placental tissue, mammary gland tissue, gastrointestinal tissue, musculoskeletal tissue, genitourinary tissue, bone marrow, and the like, derived from, for example, a human or other mammal and includes the connecting material and the liquid material in association with the cells and/or tissues. A body fluid is a liquid material derived from, for example, a human or other mammal. Such body fluids include, but are not limited to, mucous, blood, plasma, serum, serum derivatives, bile, blood, maternal blood, phlegm, saliva, sputum, sweat, amniotic fluid, menstrual fluid, mammary fluid, peritoneal fluid, urine, semen, and cerebrospinal fluid (CSF), such as lumbar or ventricular CSF. A sample may also be a fine needle aspirate or biopsied tissue. A sample also may be media containing cells or biological material. A sample may also be a blood clot, for example, a blood clot that has been obtained from whole blood after the serum has been removed.

In one embodiment, the biological sample can be a blood sample, from which plasma or serum can be extracted. The blood can be obtained by standard phlebotomy procedures and then separated. Typical separation methods for preparing a plasma sample include centrifugation of the blood sample. For example, immediately following blood draw, protease inhibitors and/or anticoagulants can be added to the blood sample. The tube is then cooled and centrifuged, and can subsequently be placed on ice. The resultant sample is separated into the following components: a clear solution of blood plasma in the upper phase; the buffy coat, which is a thin layer of leukocytes mixed with platelets; and erythrocytes (red blood cells). Typically, 8.5 mL of whole blood will yield about 2.5-3.0 mL of plasma.

Blood serum is prepared in a very similar fashion. Venous blood is collected, followed by mixing of protease inhibitors and coagulant with the blood by inversion. The blood is allowed to clot by standing tubes vertically at room temperature. The blood is then centrifuged, wherein the resultant supernatant is the designated serum. The serum sample should subsequently be placed on ice.

Prior to analyzing a sample, the sample may be purified, for example, using filtration or centrifugation. These techniques can be used, for example, to remove particulates and chemical interference. Various filtration media for removal of particles includes filer paper, such as cellulose and membrane filters, such as regenerated cellulose, cellulose acetate, nylon, PTFE, polypropylene, polyester, polyethersulfone, polycarbonate, and polyvinylpyrolidone. Various filtration media for removal of particulates and matrix interferences includes functionalized membranes, such as ion exchange membranes and affinity membranes; SPE cartridges such as silica- and polymer-based cartridges; and SPE (solid phase extraction) disks, such as PTFE- and fiberglass-based. Some of these filters can be provided in a disk format for loosely placing in filter holdings/housings, others are provided within a disposable tip that can be placed on, for example, standard blood collection tubes, and still others are provided in the form of an array with wells for receiving pipetted samples. Another type of filter includes spin filters. Spin filters consist of polypropylene centrifuge tubes with cellulose acetate filter membranes and are used in conjunction with centrifugation to remove particulates from samples, such as serum and plasma samples, typically diluted in aqueous buffers.

Filtration is affected in part, by porosity values, such that larger porosities filter out only the larger particulates and smaller porosities filtering out both smaller and larger porosities. Typical porosity values for sample filtration are the 0.20 and 0.45 μm porosities. Samples containing colloidal material or a large amount of fine particulates, considerable pressure may be required to force the liquid sample through the filter. Accordingly, for samples such as soil extracts or wastewater, a pre-filter or depth filter bed (e.g. "2-in-1" filter) can be used and which is placed on top of the membrane to prevent plugging with samples containing these types of particulates.

In some cases, centrifugation without filters can be used to remove particulates, as is often done with urine samples. For example, the samples are centrifuged. The resultant supernatant is then removed and frozen.

After a sample has been obtained and purified, the sample can be analyzed to determine the concentration of one or more target analytes, such as elements within a blood plasma sample. With respect to the analysis of a blood plasma sample, there are many elements present in the plasma, such as proteins (e.g., Albumin), ions and metals (e.g., iron), vitamins, hormones, and other elements (e.g., bilirubin and uric acid). Any of these elements may be detected using methods of the invention. More particularly, methods of the invention can be used to detect molecules in a biological sample that are indicative of a disease state.

Incorporation by Reference

References and citations to other documents, such as patents, patent applications, patent publications, journals, books, papers, web contents, have been made throughout this disclosure. All such documents are hereby incorporated herein by reference in their entirety for all purposes.

Equivalents

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

EXAMPLES

Example 1: Materials and Methods

Chemicals: Acetyl-L-carnitine ($C_2$ side chain) hydrochloride, propionyl-L-carnitine ($C_3$), isobutyryl-L-carnitine ($C_4$), isovaleryl-L-carnitine ($C_5$), and hexanoyl-L-carnitine ($C_6$) were purchased from Sigma Aldrich (St. Louis, Mo., USA). These compounds were dissolved and diluted in 50:50 methanol/water. Amphetamine, methamphetamine, 3,4-methylenedioxyamphetamine, and 3,4-methylenedioxymethamphetamine were purchased from Cerilliant (Round Rock, Tex., USA) and were diluted in methanol to concentrations between 0.25 and 1 ppm. Pierce ESI LTQ calibration mixture containing caffeine, the peptide MRFA, and Ultramark 1621[46] was obtained from Thermo Fisher (Rockford, Ill., USA). Organosolv switchgrass lignin was prepared as previously described[47] and dissolved initially in 50:50 water:tetrahydrofuran but then diluted further in 50:50 methanol:water.

Ionization: Nanoelectrospray ionization (nESI) was used for production of analyte ions in the majority of this study. Typical operating parameters were 1,500 V spray voltage using 5 μm nanospray tips pulled from borosilicate glass capillaries (1.5 mm O.D., 0.86 I.D.; Sutter Instrument Co., Novato, Calif., USA) by a Flaming/Brown micropipette puller (model P-97; Sutter Instrument Co.).

A leaf from a *Populus deltoides* tree (latitude 40.464, longitude −86.968) was analyzed by leaf spray ionization tandem mass spectrometry. For this experiment, a triangle (~8 mm height, 5 mm width) was from the leaf, held in a copper clip, and 5 kV was applied to the leaf after addition of 20 μL of methanol/water in order to generate ions for analysis.

The positive ion mode was used for all experiments. Ion injection time was generally set at 5 ms but was manually optimized to prevent trap overloading. Automatic gain control was not used in these Examples.

Figure 2A:
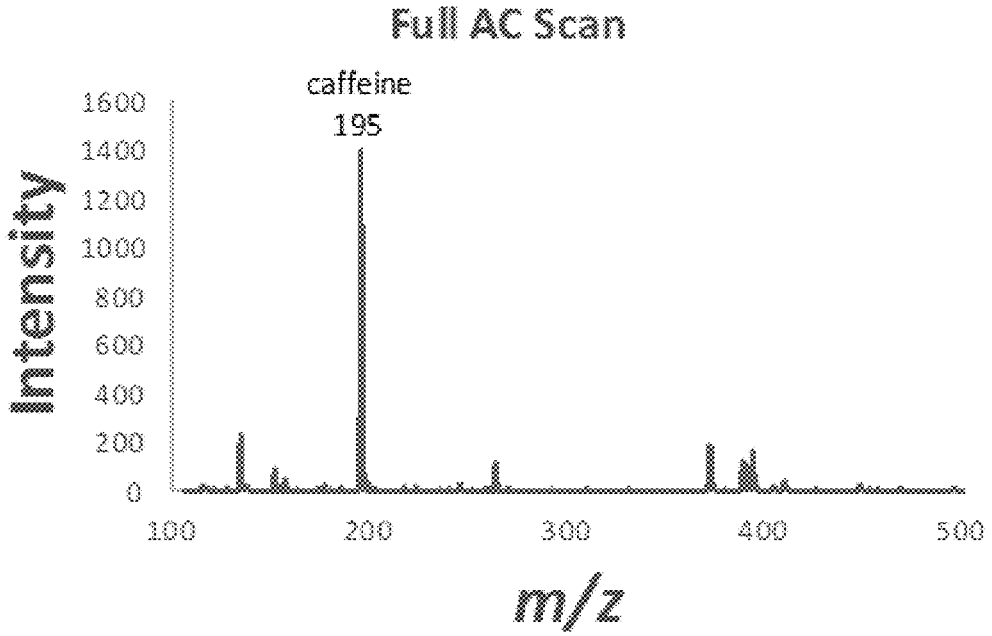
FIGS. 2A-E show that a combination of three AC frequency sweeps performed at the same mass scan rate gives an unambiguous neutral loss scan.
Figure 2B:
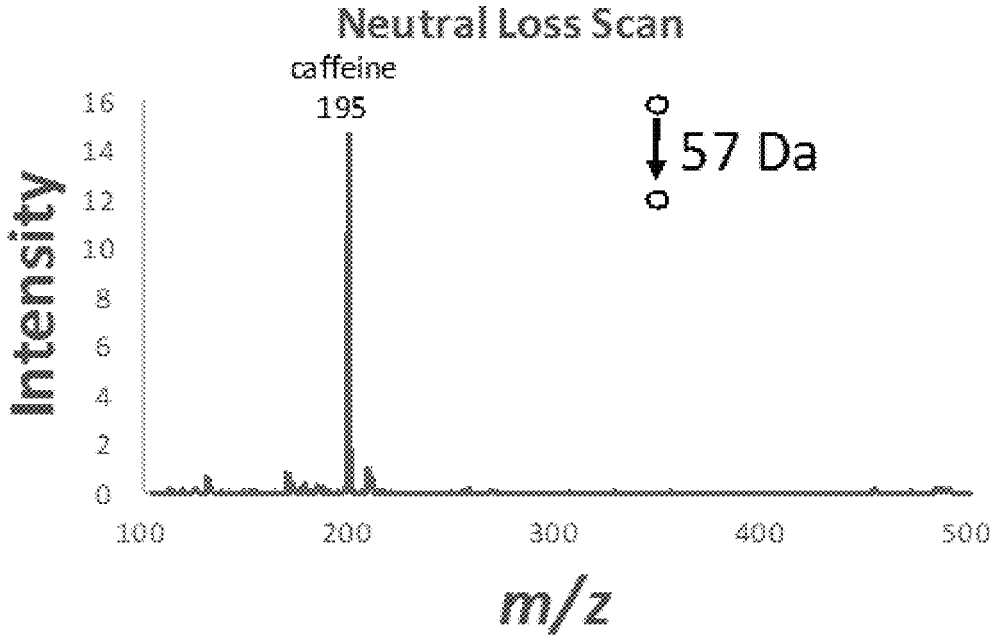
Figure 2C:
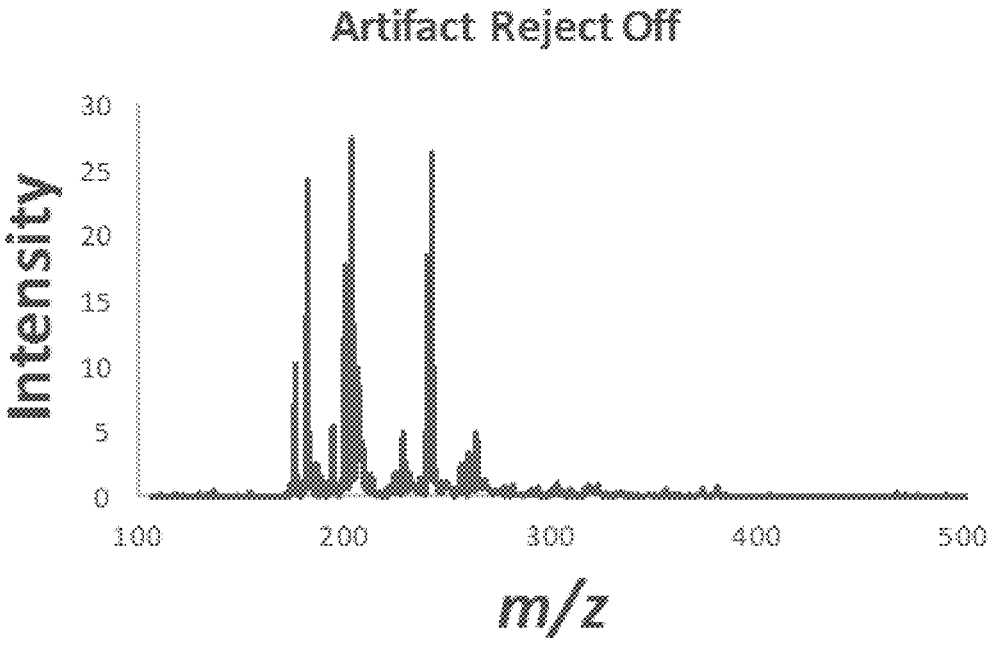
Figure 2D:
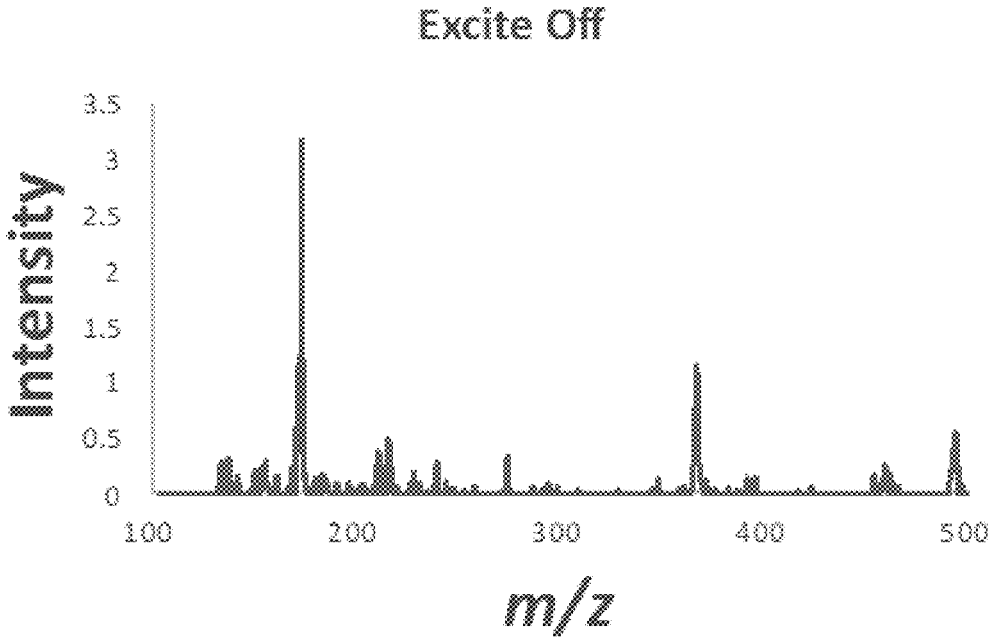
Figure 2E:
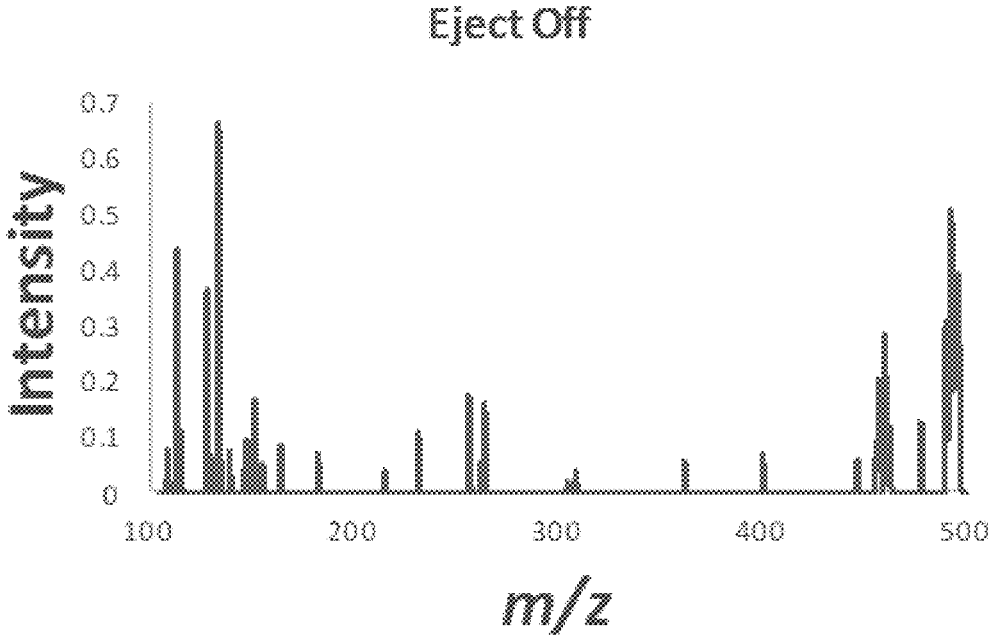

Example 2: Validation of Neutral Loss Scanning by Double Resonance Excitation In order to experimentally validate whether neutral loss scans are viable using a single linear ion trap, particularly with respect to artifact rejection, experiments were begun with a very simple LTQ calibration mixture containing caffeine, the peptide MRFA, and Ultramark 1621 phosphazine molecules. To validate artifact rejection, only the low mass range (i.e. region surrounding the m/z of protonated caffeine) was considered. FIG. 2A shows a full mass scan in this mass range (LMCO=100 Th) using a 300 ms inverse Mathieu q scan from Mathieu q=0.908 to q=0.15. Only caffeine, m/z 195, is present in high abundance and hence it should also be the only ion detected in a neutral loss scan of 57 Da (m/z 195->138). As shown in FIGS. 2B-E, the neutral loss scan with all three AC frequency sweeps applied simultaneously gave the best unambiguous mass spectrum (FIG. 2B). With the artifact rejection frequency off (FIG. 2C), several peaks are observed to confound the data, and with either the excitation (FIG. 2D) or ejection (FIG. 2E) frequencies off, virtually no ions are detected. Note the different intensity scales for each plot.

Example 3: Screening of Illicit Drugs

Figure 3A:
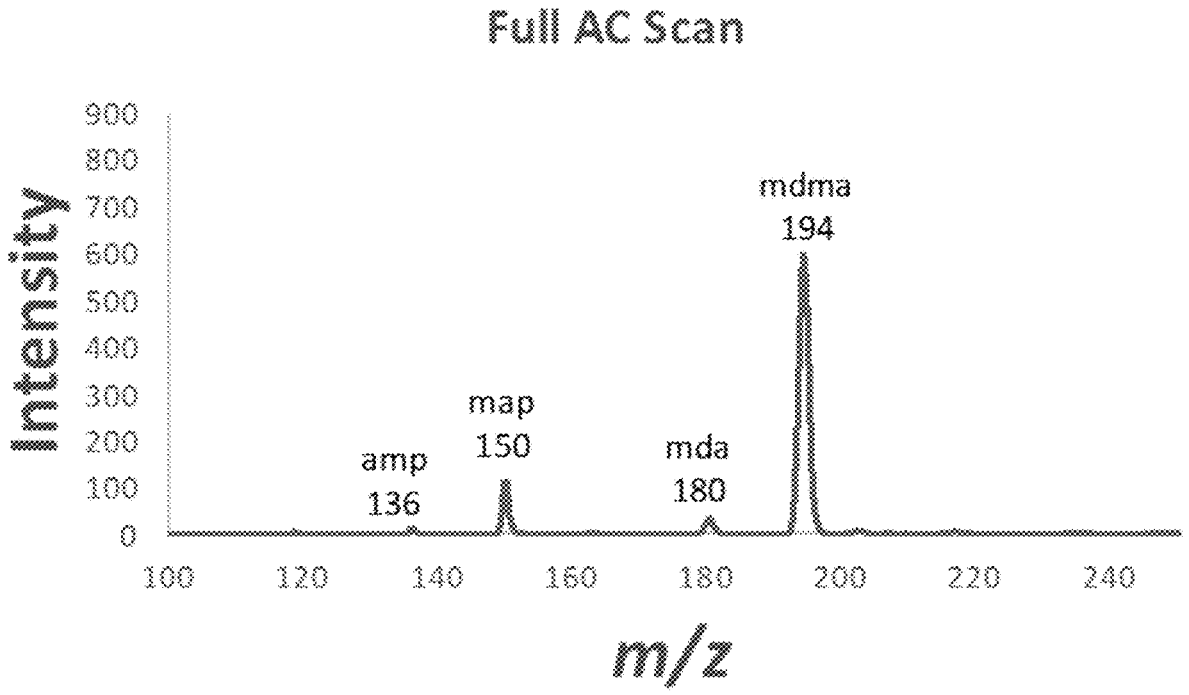
FIGS. 3A-C show single analyzer neutral loss scans of amphetamines.
Figure 3B:
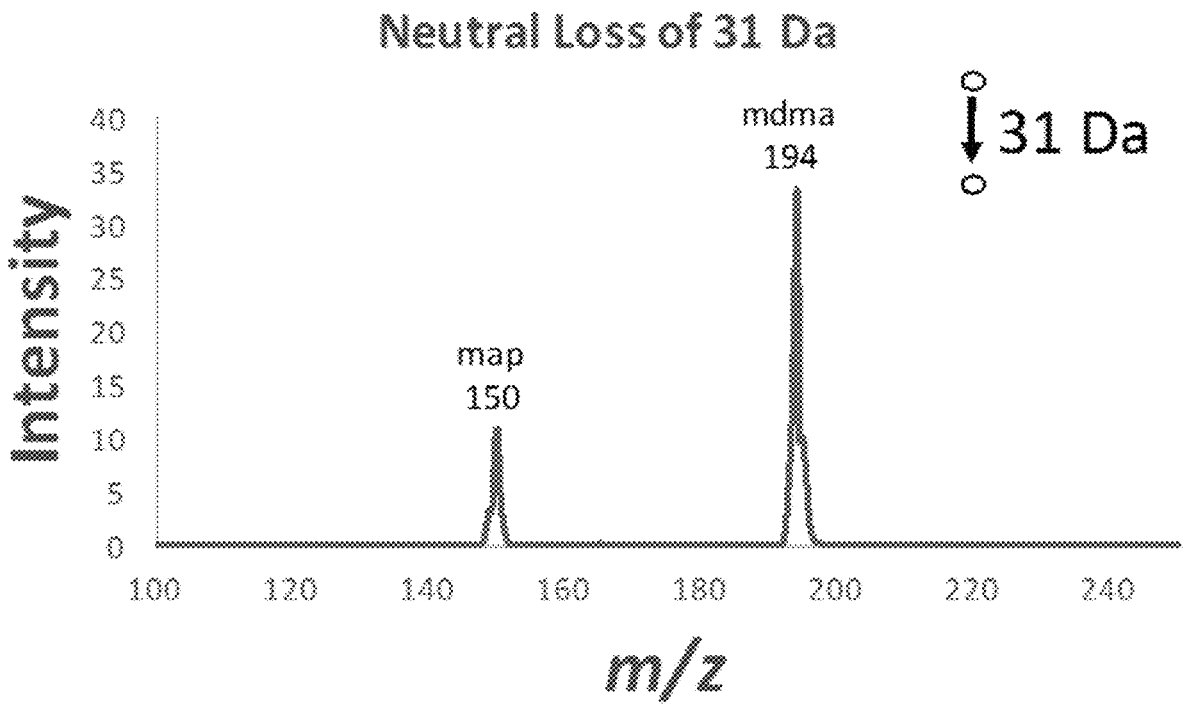
Figure 3C:
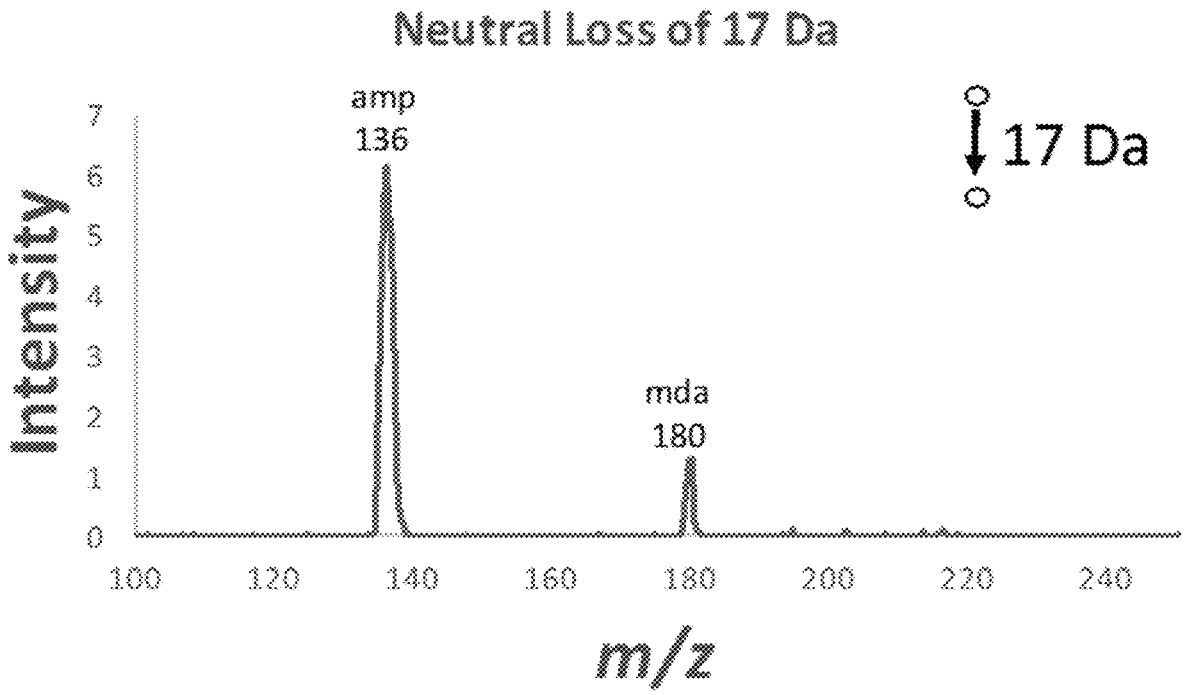

A neutral loss scan of 31 Da returns methamphetamine (map) and 3,4-methylenedioxymethamphetamine (mdma) (FIGS. 3B-C, compare to full scan in FIG. 3A) whereas a neutral loss scan of 17 Da ($NH_3$) reveals amphetamine (amp) and 3,4-methylenedioxyamphetamine (mda), despite their low intensity (<25 counts) in the full mass scan. For the latter scan, differences in fragmentation efficiency or differences in precursor ion Mathieu q parameter can account for the relative intensity shifts from the full scan to the neutral loss scan. Remarkably, neither neutral loss scan shows beat frequency effects or other artifacts which may be caused by simultaneous excitation of multiple ions. Also note how cleanly the neutral loss scans of 31 Da and 17 Da distinguish the four amphetamines.

Example 4: Screening of Acylcarnitines

Figure 4:
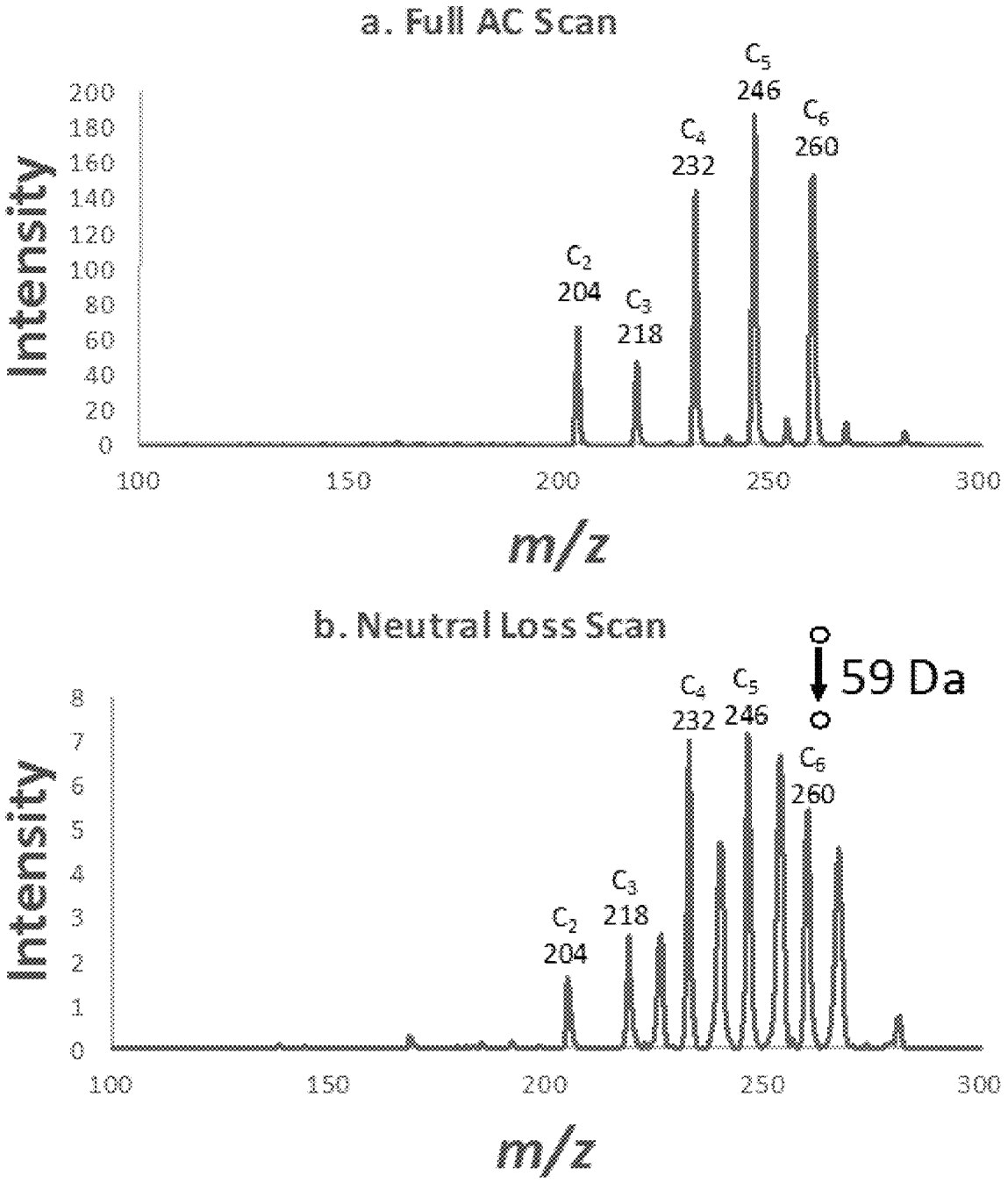
FIG. 4 panels A-B show single analyzer neutral loss scanning of acylcarnitines: (A) full AC scan of acetylcarnitine (m/z 204), propionylcarnitine (m/z 218), isobutyrylcarnitine (m/z 232), isovalerylcarnitine (m/z 246), and hexanoylcarnitine (m/z 260), and (B) neutral loss scan of 59 Da. Note that the peaks between the labeled masses were also observed to lose 59 Da in LTQ MS/MS and hence are not artifacts.

In the premier demonstration of data-dependent ion trap precursor ion and neutral loss scanning (McClellan et al., Anal. Chem. 2002, 74, 5799-5806), acylcarnitines were analyzed, which offer similar product ions as well as similar neutral losses. That method required a complex sequence of scan segments and algorithms in order to select precursor ions for activation as well as to resonantly eject product ions without also ejecting other precursor ions. Although that method would be expected to yield higher sensitivity and resolution than the method proposed here (because each precursor ion is given more time on resonance and more time for product ion collisional cooling), the complexity and inefficiency of the scan with respect to electronics, data system, time, and hence power consumption makes it unsuitable for resource constrained ion traps. Using the reported common neutral loss of 59 Da, we were able to perform a similar but data-independent neutral loss experiment with acetyl-, propionyl-, isobutyryl-, isovaleryl-, and hexanoyl-L-carnitine using a single ion injection (5 ms injection time) and a single 300 ms mass scan period. As shown in FIG. 4 panel B (compare to full scan in panel A), all of the acylcarnitines are detected, although only ~4% of the precursor ion intensity is observed due to the short activation time. The intensity in the neutral loss scan can be increased by decreasing the scan rate, giving precursor ions longer resonance times and thus increasing the conversion of precursor ions to product ions. Other peaks were observed between the main analyte peaks. They were confirmed to also lose 59 Da in LTQ MS/MS and hence are not artifacts, although they are not necessarily due to the known constituents of the acylcarnitine sample.

Example 5: Screening of Phenolic Glycosides in a *Populus Deltoides* Leaf

Figure 5:
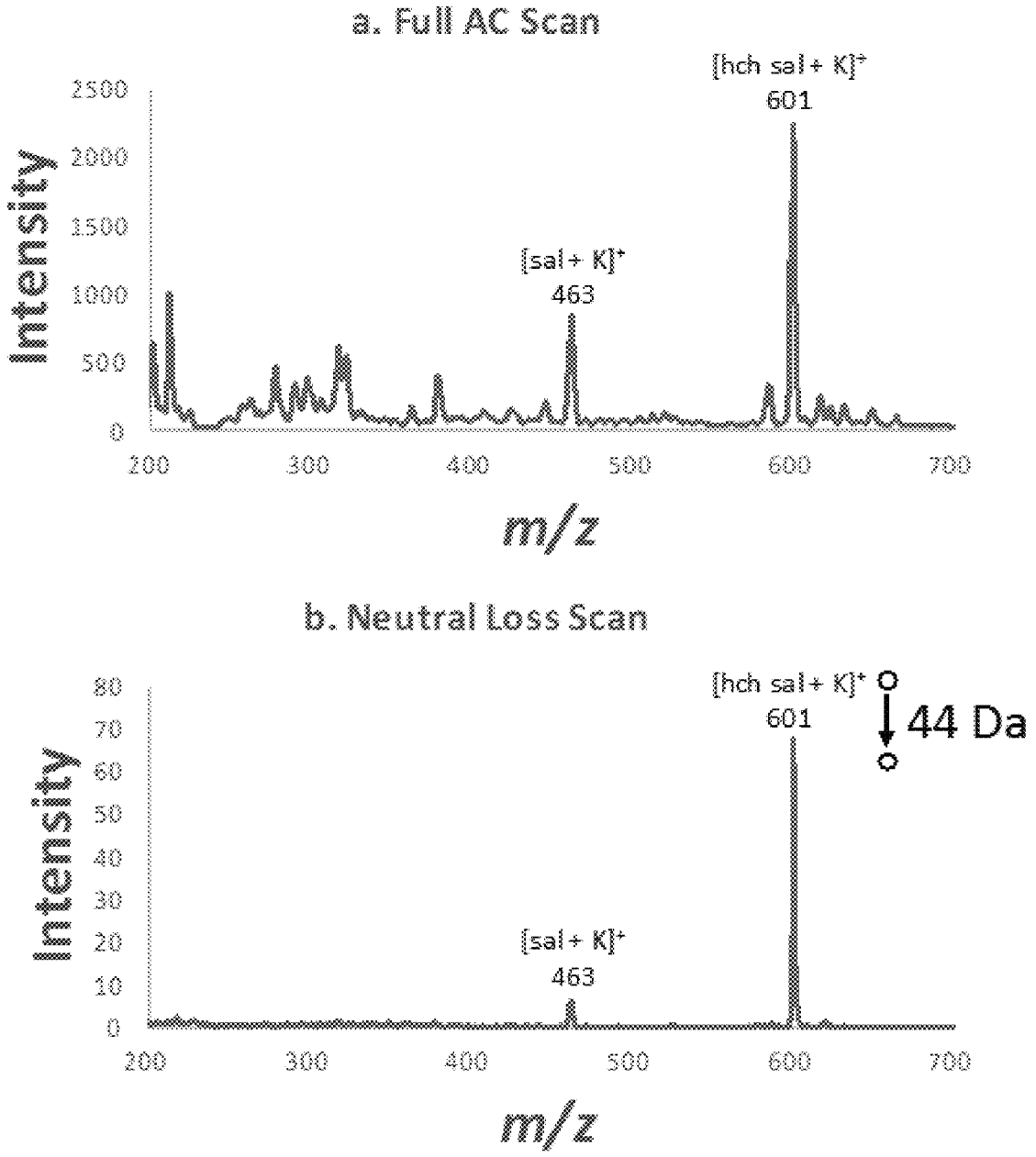
FIG. 5 panels A-B show single analyzer neutral loss scanning of a *Populus deltoides* leaf: (A) full scan mass spectrum and (B) neutral loss scan of 44 Da, targeting phenolic glycosides salicortin (sal) and HCH salicortin (hch sal).

Moving to a complex mixture is a significant step for any scan mode, as additional complexity can easily result in addition of artifact peaks as well as suppression of analyte signal. As an initial demonstration of analysis of complex mixtures using a data-independent single analyzer neutral loss scan, an individual leaf of a *Populus deltoides* tree was chosen. The *Populus* genus is well-known to contain phenolic glycosides, which are defense chemicals that deter herbivores and decrease their fitness. Previously they have been analyzed by leaf spray ionization tandem mass spectrometry using a triple quadrupole mass spectrometer (Snyder et al., Anal. Methods 2015, 7, 870-876, the content of which is incorporated by reference herein in its entirety). Potassiated salicortin and HCH salicortin (structures in Snyder et al.) were observed as the dominant ions in the full scan, as they were in this Example (FIG. 5 panel A). It was noted previously that neutral losses of 44 Da in the positive ion mode ($C_2H_4O$ or $CO_2$, but exact mass measurements were not used in this Example) are common amongst the phenolic glycosides, and hence a neutral loss scan ought to filter out most other chemicals.

A neutral loss scan of 44 Da (FIG. 5 panel B) revealed both potassiated salicortin as well as HCH salicortin. About 3% of the precursor ions were converted to detected product ions, in line with the data in the previous case. Despite the chemical complexity of the leaf, virtually no other peaks were observed in the neutral loss spectrum.

Example 6: Screening of Components in Organosolv Lignin

The previous Example provided evidence that a complex mixture can be vastly simplified using a single data-independent neutral loss scan in a single quadrupole ion trap. One might think, however, that ions of lower abundance than salicortin were not detected in the neutral loss scan because they were present at low concentrations. A mixture with a large set of ions of varying abundances that could be detected using a single neutral loss scan was thus therefore examined.

Organosolv switchgrass lignin is a complex mixture of phenolic compounds and carbohydrates—as well as other molecules with similar functionality—that has previously been characterized by HPLC-MS/MS in a linear quadrupole ion trap coupled to a Fourier transform ion cyclotron resonance mass spectrometer.[47] The work was performed primarily in negative ion mode because most of the ions produced in the positive ion mode lose 18 Da (water) in MS/MS, and hence MS/MS spectra in positive mode do not distinguish the various classes of molecules. However, for the purposes of determining the dynamic range of the neutral loss scan, the positive ion mode provides a reasonable set of analytes for examination.

Figure 6:
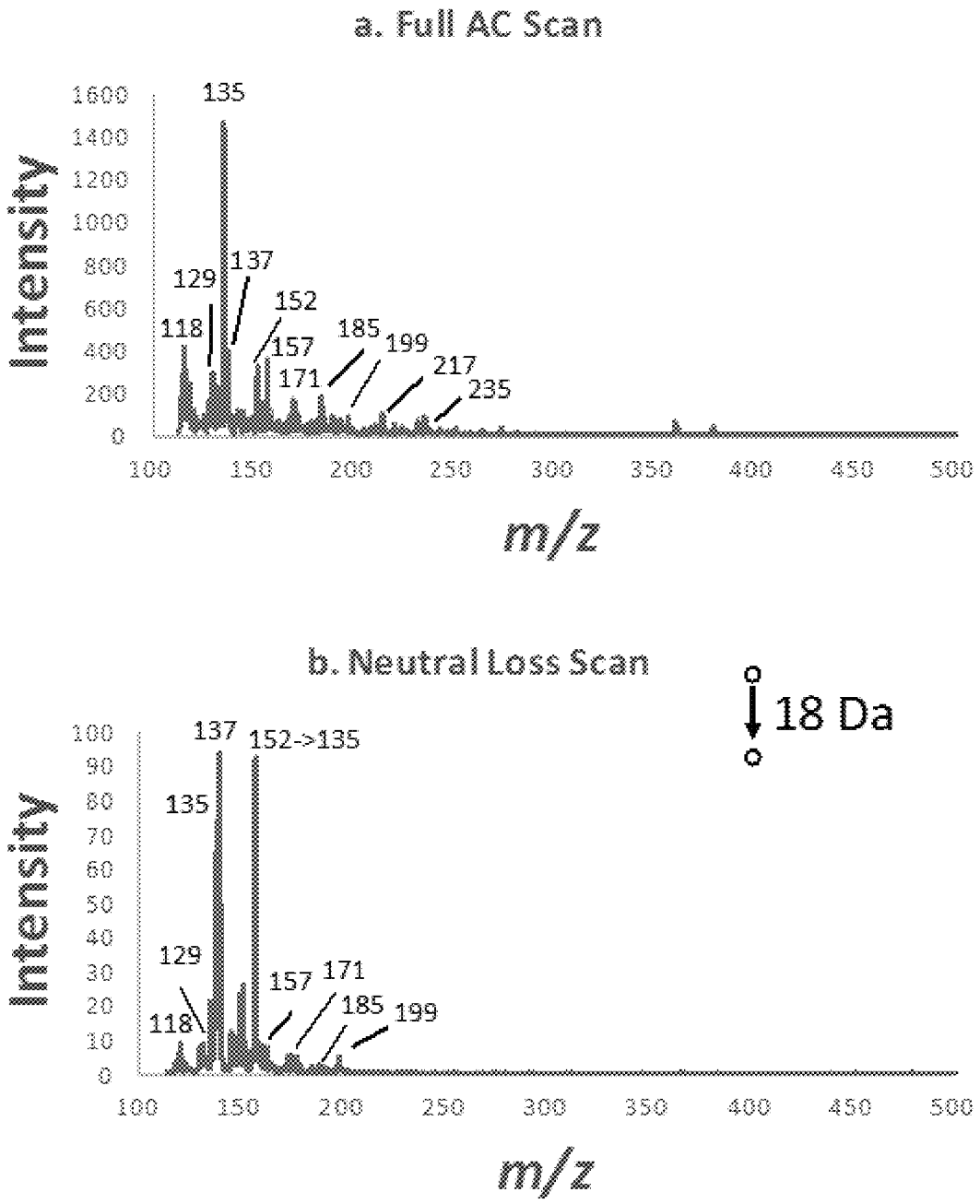
FIG. 6 panels A-B show single analyzer neutral loss scan of organosolv lignin: (A) full scan mass spectrum and (B) neutral loss scan of 18 Da.

As shown in FIG. 6 panel A, the full scan mass spectrum of organosolv lignin is complex, but most of the molecules present in the full scan lose 18 Da in MS/MS. As shown in FIG. 6 panel B, a neutral loss scan of 18 Da returns not just the ions of high abundance, but also those of low abundance.

What is claimed is:

1. A method of operating an ion trap, the method comprising: applying a scan function to a single ion trap that excites a precursor ion, rejects the precursor ion after its excitation, and ejects a product ion from the single ion trap.

2. The method according to claim 1, wherein the scan function comprises three swept-frequency scans.

3. The method according to claim 2, wherein the three swept-frequency scans are applied simultaneously to the single ion trap.

4. The method according to claim 3, wherein each of the three swept-frequency scans is an inverse Mathieu q scan.

5. The method according to claim 4, wherein a first frequency sweep excites the precursor ion.

6. The method according to claim 5, wherein a second frequency sweep rejects the precursor ion after its excitation.

7. The method according to claim 6, wherein a third frequency sweep ejects a product ion in the single ion trap.

8. The method according to claim 7, wherein the second frequency sweep is between the first frequency sweep and the third frequency sweep.

9. The method according to claim 8, wherein a constant mass offset is maintained between the first frequency sweep and the third frequency sweep.

10. The method according to claim 9, wherein the first frequency sweep comprises a lower amplitude than either the second or third frequency sweeps.

11. A method for operating an ion trap, the method comprising: conducting a neutral loss scan in a single ion trap through simultaneous application of three swept-frequency scans to the single ion trap.

12. The method according to claim 11, wherein each of the three swept-frequency scans is an inverse Mathieu q scan.

13. The method according to claim 12, wherein a first frequency sweep excites a precursor ion in the single ion trap.

14. The method according to claim 13, wherein a second frequency sweep rejects the precursor ion after its excitation.

15. The method according to claim 14, wherein a third frequency sweep ejects a product ion in the single ion trap.

16. The method according to claim 15, wherein the second frequency sweep is between the first frequency sweep and the third frequency sweep.

17. The method according to claim 16, wherein a constant mass offset is maintained between the first frequency sweep and the third frequency sweep.

18. The method according to claim 17, wherein the first frequency sweep comprises a lower amplitude than either the second or third frequency sweeps.

19. The method according to claim 18, wherein the first and second frequency sweeps are applied in a y dimension.

20. The method according to claim 19, wherein the third frequency sweep is applied in an x dimension and a detector of a mass spectrometer is also in the x dimension.

* * * * *